US008594818B2

(12) United States Patent
Boe

(10) Patent No.: US 8,594,818 B2
(45) Date of Patent: Nov. 26, 2013

(54) PRODUCTION MONITORING SYSTEM AND METHOD

(75) Inventor: Arild Boe, Stavanger (NO)

(73) Assignee: Production Monitoring AS, Kokstad (NO)

( * ) Notice: Subject to any disclaimer, the term of this patent is extended or adjusted under 35 U.S.C. 154(b) by 467 days.

(21) Appl. No.: 12/887,126

(22) Filed: Sep. 21, 2010

(65) Prior Publication Data

US 2012/0072186 A1 Mar. 22, 2012

(51) Int. Cl.

| | |
|---|---|
| ***E21B 21/08*** | (2006.01) |
| ***E21B 47/00*** | (2012.01) |
| ***E21B 47/10*** | (2012.01) |
| ***G05B 11/01*** | (2006.01) |
| ***G05B 13/02*** | (2006.01) |
| ***G05B 15/02*** | (2006.01) |
| ***G21C 17/00*** | (2006.01) |
| ***G06F 17/00*** | (2006.01) |
| ***G06F 19/00*** | (2011.01) |
| ***G01L 21/02*** | (2006.01) |
| ***G01N 7/00*** | (2006.01) |
| ***G01N 11/00*** | (2006.01) |

(52) U.S. Cl.

USPC ... 700/95; 700/9; 700/14; 700/29; 73/152.01; 73/152.18; 73/152.21; 73/152.22; 702/6; 702/50; 702/138; 702/182; 703/2

(58) Field of Classification Search

USPC ..... 700/9, 14, 29, 95; 73/152.06, 152.01, 73/152.18, 152.21, 152.22; 702/6, 50, 702/138, 182; 706/2; 703/2

See application file for complete search history.

(56) References Cited

U.S. PATENT DOCUMENTS

| | | | | |
|---|---|---|---|---|
| 4,158,138 | A * | 6/1979 | Hellstrom | 378/116 |
| 5,886,255 | A * | 3/1999 | Aronstam | 73/152.01 |
| 6,434,435 | B1 * | 8/2002 | Tubel et al. | 700/30 |
| 2003/0220750 | A1 * | 11/2003 | Delhomme et al. | 702/50 |
| 2008/0059002 | A1 * | 3/2008 | Hartkamp et al. | 700/299 |

(Continued)

FOREIGN PATENT DOCUMENTS

WO WO 2008/100148 A2 8/2008

OTHER PUBLICATIONS

Naevdal, G., Johnsen, L.M., Aanonsen, S.I., Vefring, E.H., "Reservoir Monitoring and Continuous Model Updating Using Ensemble Kalman Filter," SPE International, SPE 84372, SPE Annual Technical Conference and Exhibition held in Denver, Colorado, USA, Oct. 5-8, 2003, pp. 1-12.*

*Primary Examiner* — Mohammad Ali
*Assistant Examiner* — Jennifer L Norton
(74) *Attorney, Agent, or Firm* — McDermott Will & Emery LLP

(57) ABSTRACT

A production monitoring system (10) comprises a plurality of injection and production units (80) coupled in operation to sensors (410) for measuring physical processes occurring in operation in the injection and production units (80) and generating corresponding measurement signals (420) for computing hardware (400). The computing hardware (400) is operable to execute software products (300) for processing the signals (420). Moreover, the software products (300) are adapted for the computing hardware (400) to analyze the measurement signals (420) to abstract a parameter representation of the measurement signals (420), and to apply a temporal analysis of the parameters to identify temporally slow processes and temporally fast processes therein, and to employ information representative of the slow processes and fast processes to control a management process for controlling operation of the system (10).

12 Claims, 6 Drawing Sheets

(56) References Cited

U.S. PATENT DOCUMENTS

2008/0201728 A1* 8/2008 Midttun et al. ..... 719/328
2009/0157590 A1* 6/2009 Mijares et al. ..... 706/61
2010/0198570 A1* 8/2010 Sarma et al. ..... 703/10
2012/0095733 A1* 4/2012 Rossi ..... 703/2

* cited by examiner

PRODUCTION MONITORING SYSTEM AND METHOD

TECHNICAL FIELD OF INVENTION

The present invention relates to production monitoring systems for monitoring production and injection from a configuration of oil and/or gas wells. Moreover, the invention concerns methods of monitoring aforesaid oil and/or gas wells for controlling operation of the wells. Furthermore, the invention relates to software products recorded on machine-readable data storage media, wherein the software products are executable upon computing hardware for implementing the aforementioned methods.

BACKGROUND TO THE INVENTION

Referring to FIG. 1, a contemporary oil and/or gas production system 10 includes multiple production and injection wells 80 including corresponding boreholes 20 penetrating into an underground geological formation 30 bearing an oil deposit 40 and/or a gas deposit 50. Often, the geological formation 30 corresponds to one or more anticlines 60 which form a natural containment for the oil deposit 40 and/or gas deposit 50. The geological formation 30 is usually highly heterogeneous. The deposits 40, 50 are often contained within regions of porous rock with multiple fissures, cavities and structural weaknesses which define maximum pressures which can be sustained by the regions during oil and/or gas extraction. Excessive pressure applied to the geological formation 30, for example via water injection, can risk causing multiple unwanted fractures, namely "out of zone" fractures. When the geological formation 30 is associated with the system 10 being offshore, fracturing of boreholes 20 of the system 10 can cause multiple seabed surface fissures which can leak water and/or hydrocarbons, namely potentially causing severe environmental pollution in an offshore environment.

A contemporary problem is that software tools for controlling oil and/or gas production systems are insufficiently evolved for coping with complex dynamic characteristics of spatially-extensive porous oil and/or gas wells, namely a system of producers and injectors operating in conjunction with a heterogeneous porous medium.

During recent years, oil and gas production systems have evolved to use real time data to an increasing extent. As sensor technology has become more reliable, engineers operating these systems are increasingly desirous to receive downhole data such as pressure and temperature, acoustic noise data for sand detection, multiphase flow and similar. These data provide the engineers with valuable information regarding the system and are employed both for detecting occurrence of various events, for example sand bursts, and to optimize production.

Control of oil and/or gas production systems 10 having multiple input and output parameters has been previously described in a published international PCT patent application no. WO2008/100148A2 (Nordtvedt & Midttund, Epsis AS). When these systems 10 exhibit complex dynamic characteristics with potentially abrupt temporal phenomena occurring, correct and safe control of the systems 10 requires special attention for achieving optimal production performance whilst simultaneously ensuring that safe and reliable operation is achieved. A difficulty arising is that contemporary software tools for controlling the system 10 are insufficiently capable of coping with large amounts of dynamically-acquired data, such that control and operation of the system 10 risks being compromised

SUMMARY OF THE INVENTION

The present invention seeks to provide an improved production monitoring system for providing enhanced control of complex oil and/or gas production systems.

The present invention seeks to provide an improved method of monitoring a complex production system comprising a plurality of producers and injectors operating in association with a heterogeneous porous medium.

According to a first aspect of the present invention, there is provided a production monitoring system as defined in claim 1: there is provided a production monitoring system comprising a plurality of injection and production units coupled in operation to sensors for measuring physical processes occurring in operation in the injection and production units and generating corresponding measurement signals for computing hardware, wherein the computing hardware is operable to execute software products for processing the signals, characterized in that the software products are adapted for the computing hardware to analyse the measurement signals to abstract a parameter representation of the measurement signals, and to apply a temporal analysis of the parameters to identify temporally slow processes and temporally fast processes therein, and to employ information representative of the slow processes and fast processes to control a management process for controlling operation of the system.

The invention is of advantage in that analyzing the signals from the injection and production units into a plurality of temporal processes of mutually different time durations provides valuable insight into operation of the injection and production units and thereby enables the injection and production units to be controlled better.

Optionally, in the production monitoring system, the injection and production units have associated therewith production and injection rates ($r_A$, $r_B$), together with upper and lower borehole pressures ($p_U$, $p_L$) as the sensor signals, and the management processes is adapted to control the injection and production units in respect of one or more of: production rate, operating safety, maintenance requirement.

Optionally, in the production monitoring system, the temporal analysis involves applying a temporal filter for analysing temporal characteristics of the measurement signals by modelling the measurement signals, and determining deviations between the measurement signals and corresponding modelled measurement signals for identifying the temporally fast processes. More optionally, the temporal filter employs a Kalman filter. Yet more optionally, the Kalman filter is formulated for $N_i$ injectors and $N_p$ producers as expressed by Equation 1 (Eq. 1):

$$\frac{dY_j(t)}{dt} = \sum_i K_{ji} \cdot Y_i(t) + \sum_p K_{jp} \cdot Y_p(t) + P_j^*(t) \qquad \text{Eq. 1}$$

wherein

K=parameters of the system;

Y=an output variable, measured response of the system;

P*=input variables to the system, namely pressure gradient to the system;

t=time; and i,j=reference indices, and wherein the output variable Y is defined by Equation 2 (Eq. 2) and Equation 3 (Eq. 3):

$$Y_j = \int_0^t [P_{w,j}(t') - P_r(0)] \cdot dt' \quad \text{Eq. 2}$$

$$P'_j(t) = \frac{Q_j(t)}{J_j} \quad \text{Eq. 3}$$

wherein Equation 4 (Eq. 4) defines a time derivative of the output variable:

$$\frac{dY_j}{dt} = P_{w,j}(t) - P_v(0) \quad \text{Eq. 4}$$

wherein $J_j$=set of parameters associated with the system; and $Q_j$=flow rate

Optionally, in the production monitoring system, the analysis is adapted for determining interaction between the injection and production units when intercepting a formation which is mutually common to the injection and production units.

Optionally, in the production monitoring system, the injection and production units include at least one of; oil and/or gas wells, multiple apparatus in a production facility, continuous mining facilities, geological water extraction facilities.

According to a second aspect of the invention, there is provided a method of monitoring a plurality of injection and production units, characterized in that the method includes:

(a) using sensors coupled to the injection and production units for measuring physical processes occurring in operation in the injection and production units and generating corresponding measurement signals for computing hardware, wherein the computing hardware is operable to execute software products for processing the signals;

(b) using computing hardware executing the software products to analyse the measurement signals to abstract a parameter representation of the measurement signals;

(c) using the computing hardware to apply a temporal analysis of the parameters to identify temporally slow processes and temporally fast processes therein; and (d) employing information representative of the slow processes and fast processes to control a management process for controlling operation of the system.

Optionally, the method includes the injection and production units having associated therewith production and injection rates ($r_A$, $r_B$), together with upper and lower borehole pressures ($p_U$, $p_L$) as the sensor signals, and the management processes being operable to control the injection and production units in respect of one or more of: production rate, operating safety, maintenance requirement.

Optionally, the method includes the temporal analysis involving applying a temporal filter for analysing temporal characteristics of the measurement signals by modelling the measurement signals, and determining deviations between the measurement signals and corresponding modelled measurement signals for identifying the temporally fast processes. More optionally, the temporal filter employs a Kalman filter.

According to a third aspect of the invention, there is provided a software product recorded on a machine-readable data storage medium, wherein the software product is executable on computing hardware for implementing a method pursuant to the second aspect of the invention.

DESCRIPTION OF THE DIAGRAMS

Embodiments of the present invention will now be described, by way of example only, with reference to the following diagrams wherein.

In the accompanying diagrams, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DESCRIPTION OF EMBODIMENTS OF THE INVENTION

Figure 1:
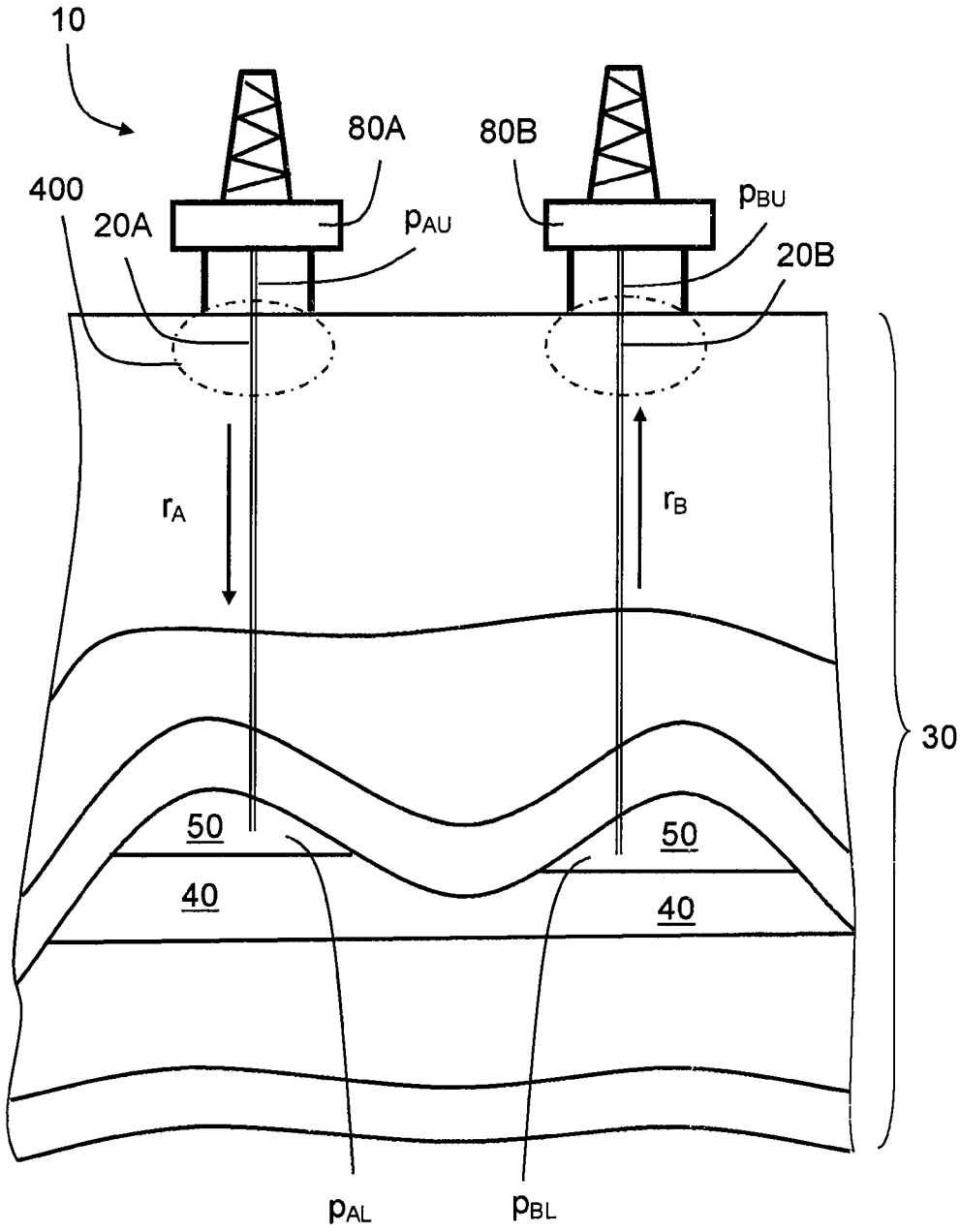
FIG. 1 is an illustration of a contemporary oil and/or gas production system including multiple wells and boreholes.
Figure 2:
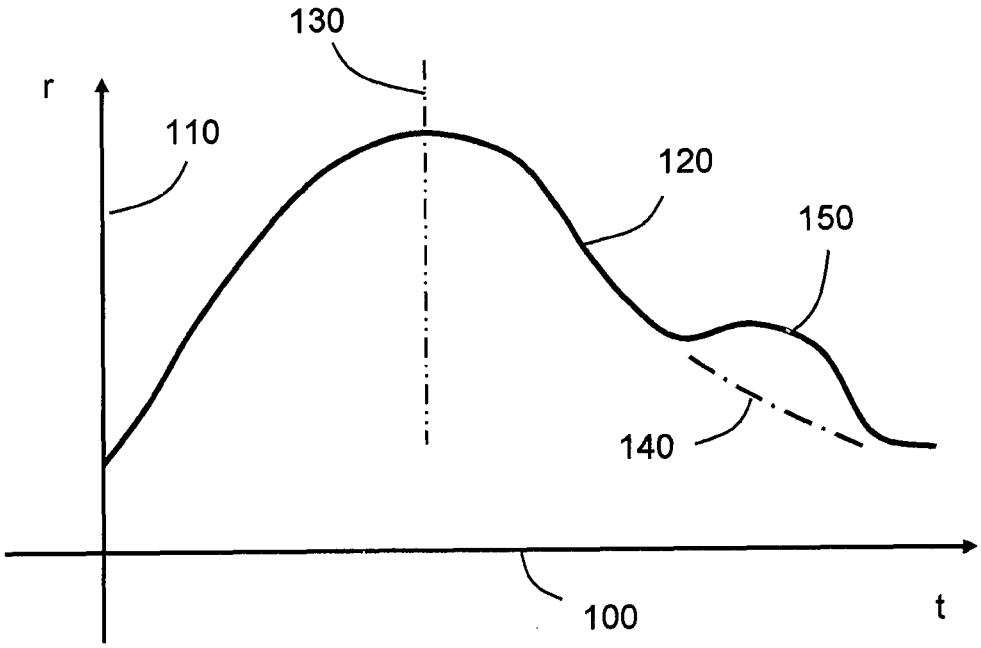
FIG. 2 is a temporal graph illustrating production performance characteristics of the system of FIG. 1.

Referring to FIG. 1 as described in the foregoing, the boreholes 20A, 20B are associated with wells 80A, 80B respectfully. The well 80A is employed to inject fluid, whereas the well 80B is employed to receive fluid from the geological formation 30. The geological formation 30 is usually heterogeneous in spatial nature. Temporally, the geological formation 30 exhibits a changing behaviour as depicted in FIG. 2 when fluid is removed from the formation 30 as denoted by a curve 120, wherein an abscissa axis 100 denotes time t, and an ordinate axis 110 represents a rate r of production of oil and/or gas from the geological formation 30. Initially, the oil deposit 40 and the gas deposit 50 will be under considerable natural pressure resulting in the well 80B producing oil and/or gas without the well 80A being required to inject fluid into the geological formation 30. Eventually, an apex 130 corresponding to maximum production rate is reached. After the apex 130, fluid increasingly has to be injected via the well 80A to maintain the production rate r from the well 80B. As the production rate r falls after the apex 130, a trajectory as denoted by 140 is eventually followed, unless advanced extraction techniques are used to flush out last remaining oil and gas from the geological formation 30 as denoted by a curve 150. For example, many older oil wells in Saudi Arabia are now believed to be past their apex 130, and Saudi Arabia is increasingly seeking oil and gas offshore in order to satisfy World demand for oil and gas.

Figure 3:
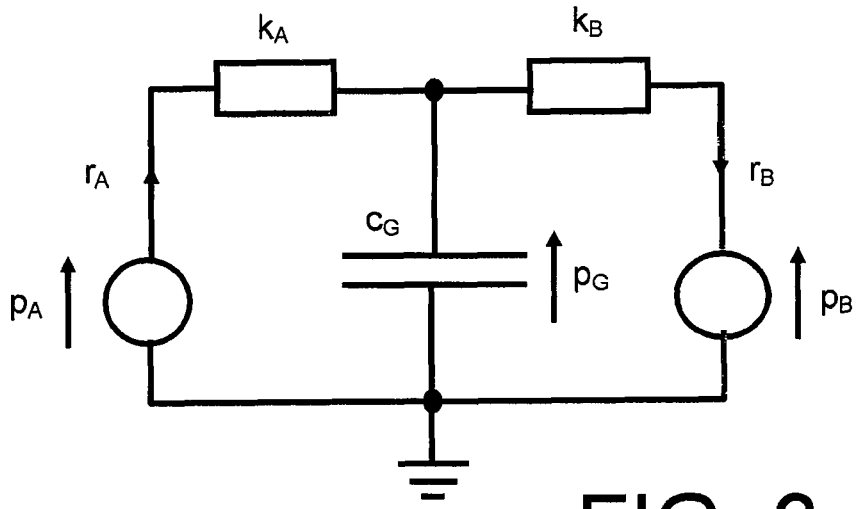
FIG. 3 is a simple representation of a pair of boreholes of the system of FIG. 1.

FIG. 2 represents a simple overview of production characteristics over a lifetime of the system 10 in respect of the borehole 20B adapted to extract fluid at a rate $r_B$ from the geological formation 30. For purposes of analysis, the system 10 can be represented as an equivalent electrical circuit as presented in FIG. 3, wherein $p_A$ represents a pressure developed by the well 80A in its borehole 20A, and $p_B$ represents a pressure developed by the well 80B in its borehole 20B. A flow resistance $k_A$ corresponds to that of a spatial region near a distal end borehole 20A, and a flow resistance $k_B$ corresponds to that of a spatial region near a distal end of the borehole 20B. The geological formation 30 is typically porous such that the oil deposit 40 and the gas deposit 50 are included within pores and cavities of the geological formation 30; the formation 30 has a spatial capacity denoted by $c_G$ and has an equivalent pressure $p_G$. Initially, the pressure $p_G$ is high from natural causes and will assist to maintain the production rate $r_B$ prior to the apex 130. Beyond the apex 130, the borehole 20A must be maintained under elevated pressure relative to the borehole 20B, in other words $p_A > p_B$, in order to maintain oil and gas production after the apex 130. After the apex 130, insufficient flow through the geological formation 30 can result in sedimentation and potential blockage, for example due to sand; conversely, excess pressure in the geological formation 30 can result in unwanted fracture. However, FIG. 3 is a gross simplification of a real oil and/or gas well. Moreover, the flow resistances $k_A$, $k_B$ can be dynamically changing, for example due to sedimentation, fracture of porous fissures, and opening of fissures as oil is removed. Similarly, the capacity $c_G$ of the geological region can also be temporally varying during oil and gas extraction. The mean pressure $p_G$ of the geological formation 30 will not be directly determinable without an additional borehole being drilled which is expensive. Already from FIG. 3, it will be appreciated that an oil and/or gas well is a complex entity to measure, monitor and analyze.

Figure 4:
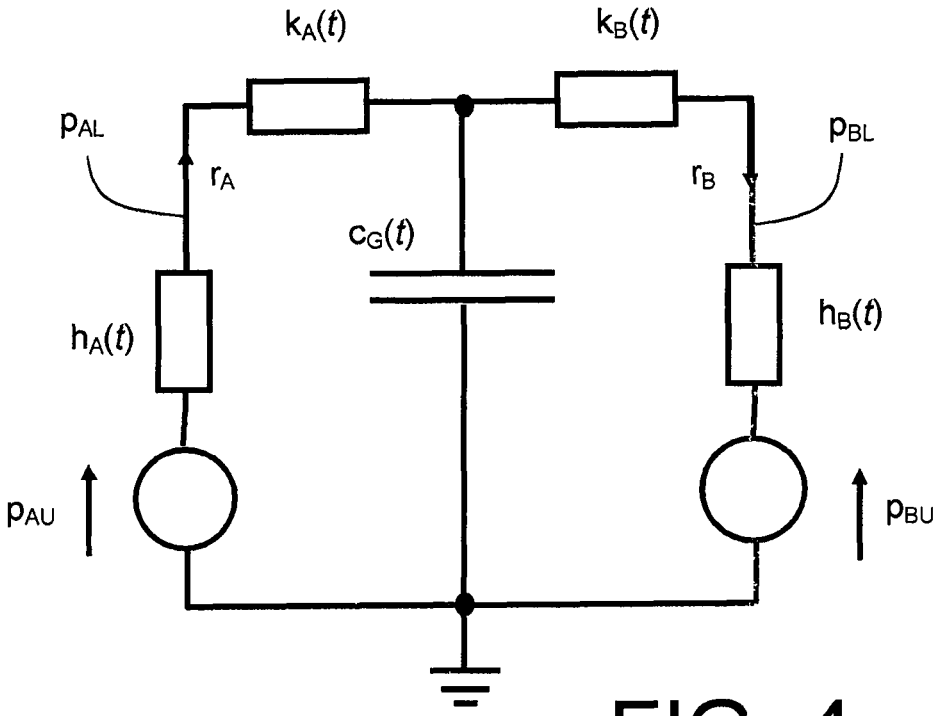
FIG. 4 is a more complex representation of a pair of boreholes of the system of FIG. 1.
Figure 5:
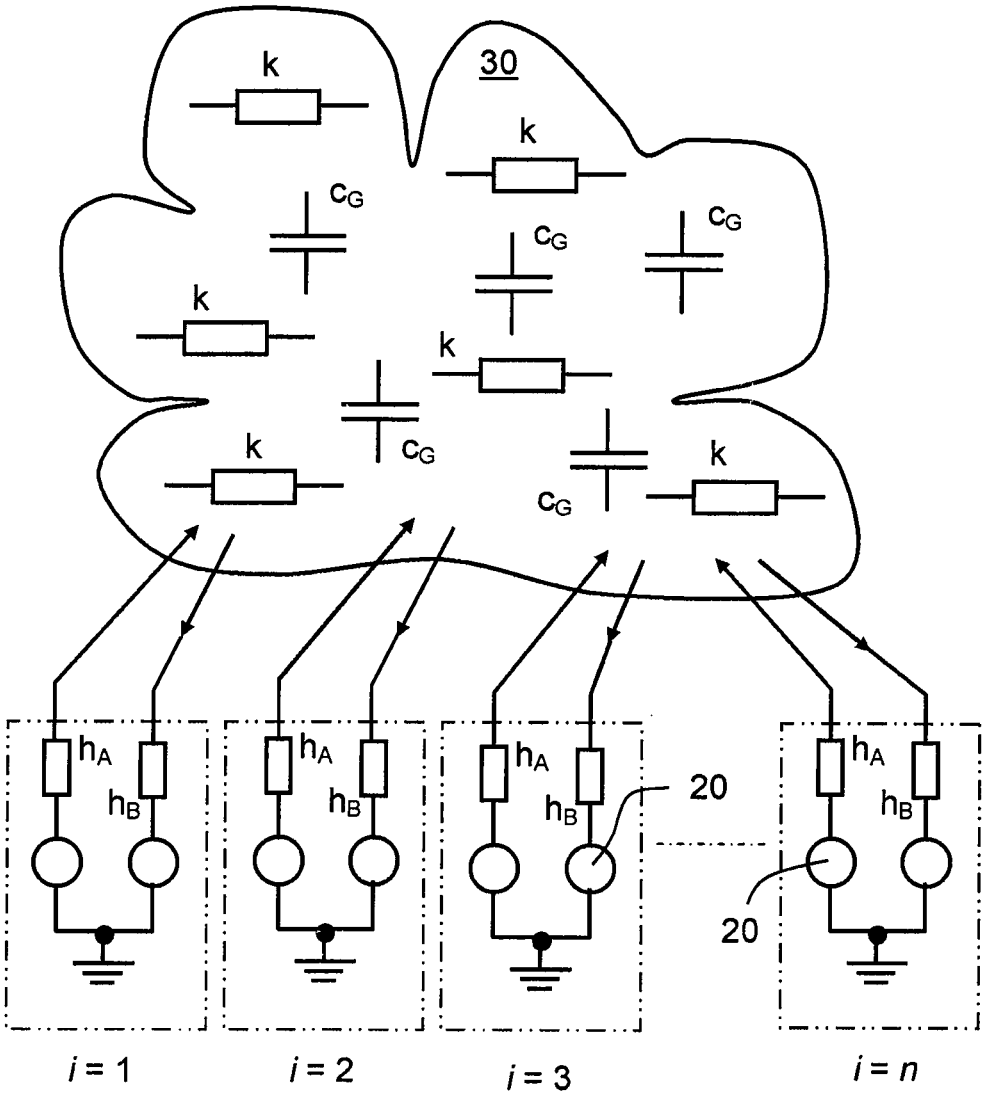
FIG. 5 is a complex representation of the system of FIG. 1 with n pairs of injection and production boreholes.

In practice, pressures can be conveniently measured at top and bottom regions of the boreholes 20A, 20A; these pressures will be referred to as $p_{AU}$ and $p_{AL}$ for the borehole 20A, and $p_{BU}$ and $p_{BL}$ for the borehole 20B. Moreover, the boreholes 20A, 20B will themselves represent flow resistance $h_A$, $h_B$ respectively to fluid flow therethrough. For example, in a case of directional drilling as contemporarily often employed in the North Sea, the boreholes 20A, 20B can be many kilometres long. If t is employed to denoted time, a better representation for FIG. 1 is provided in FIG. 4. Thus, the flow resistances $h_A$, $k_A$, $h_B$, $k_B$ as well as the capacity $c_G$ are potentially partially random functions of time t. Such complexity potentially renders the system 10 difficult to control for achieving optimal oil and/or gas production. However, such complexity extends beyond an equivalent model as represented in FIG. 4 on account of a real oil and gas producing system 10 being spatially extensive and intercepted by multiple pairs of boreholes 20, for example as represented in FIG. 5. In FIG. 5, there are n pairs of boreholes 20 which all communicate to varying extents with the geological formation 30. When the system 10 is implemented as a large production system, there are often many wells 80, and the formation 30 associated with the platforms 80 can include interlinked regions whose properties change in a complex temporal manner during oil and/or gas extraction. In practice, a complex array of boreholes 20 serves the geological formation 30 including many mutually coupled anticlines and layers of strata which exhibit unpredictable temporally varying flow resistance characteristics during oil and/or gas extraction therefrom, such that an equivalent model as illustrated in FIG. 5 is more pertinent to employ when attempting to monitor and control the system 10. It will be appreciated that optimal control of system 10 as depicted in FIG. 5 is highly complex, for example on account of the pressure $p_G$ within the geological formation 30 being a function of spatial location within formation 30. Conveniently, the pressure $p_G$ within the formation 30 is defined by $P_G(x, y, z, t)$ wherein z, y, z are Cartesian coordinates for defining a region including the formation 30, and t denotes time.

The inventors of the present invention devised improved methods of monitoring and controlling the system 10 as depicted in FIG. 5. A conventional simulated approach for monitoring and controlling the utilizing multi-parameter input and output models based on a conversion matrix for monitoring and controlling the system 10 becomes too complex and computationally intensive, even when considerable brut computing power is applied. In contradistinction, methods pursuant to the present invention are more efficient and are potentially susceptible to being implemented using relatively modest computing resources.

Figure 6:
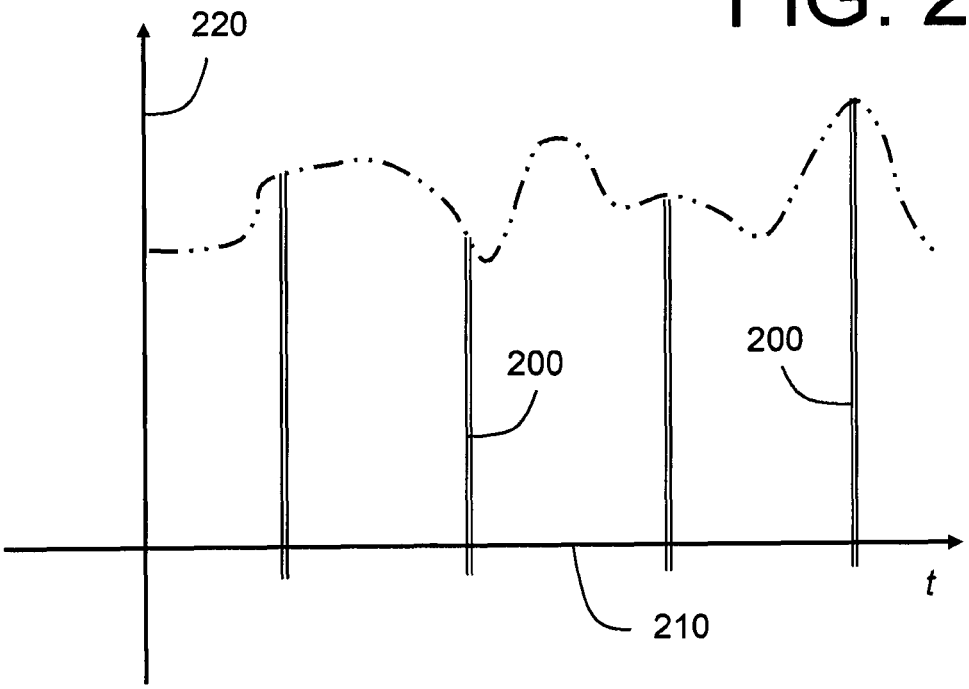
FIG. 6 is an illustration of a contemporary temporal characteristic of the system of FIG. 1 subject to periods of quasi-constant production interspersed with periodic well testing.

In the foregoing, the borehole 20A operable as an "injector" and the borehole 20B operable as a "producer" enable oil and/or gas production to occur. Continuous measurements of borehole distal pressure, namely $p_{LA}$, $p_{LB}$, and borehole proximate pressure (wellhead pressure), namely $p_{UA}$, $p_{UB}$, are made, together with measures of flow rates $r_A$, $r_B$ for the "injector" and "producer" respectively. It is conventional operating practice to obtain information about the system 10 by maintaining the flow rates r temporally quasi-constant within the system 10, and to execute periodic tests 200 as illustrated in FIG. 6. In FIG. 6, an abscissa axis 210 denotes time t, and an ordinate axis 220 denotes a parameter of the system 10, for example well-head proximate pressure. The tests 200 conventionally involve applying a step perturbation change in flow rate r by applying a step change in one or more of the flow resistance $h_A$ and/or $h_B$, or by changing the proximate wellhead pressures $p_{AU}$, $p_{BU}$ A response of the system 10 to the step change perturbation at each well 80 provides insight into the flow resistances $k_A$, $k_B$, and also the capacity $c_G$ for each well 80, namely for a portion of the geological region 30 associated with the wells 80A, 80B. For example, a time constant associated with an exponential pressure response to a step change in flow rate r provides an indication of the capacity $c_G$, and a magnitude of the pressure response provides an indication of the flow resistances $k_A$, $k_B$ associated with the wells 80. However, such a quasi-constant measurement is only approximate when the geological formation 30 is extensive, porous and is intersected by multiple sets of boreholes 20. A problem with such a conventional approach to testing boreholes 20 of a complex oil and/or gas production system is that, as illustrated in FIG. 6, various discrete temporal events can occur which can influence borehole operation significantly in periods between tests 200. Moreover, it is uneconomical and/or undesirable to increase a frequency of the tests 200 on account of them being disruptive to production.

The inventors have appreciated, when controlling the system 10 including multiple pairs of mutually interacting boreholes 20, that it is desirable to monitor several parameters, for example sand content in the flow $r_B$ in the borehole 20B by way of acoustic measurement. Moreover, it is also desirable to monitor other parameters including:

(i) productivity of the borehole 20B, namely how much oil and/or gas is being produced in the flow $r_B$;

(ii) injectivity of the borehole 20A, namely an indication of the resistance $k_A$; and (iii) a pressure within the borehole 20 as represented by one or more of the pressures $p_{AU}$, $p_{AL}$, $p_{BU}$, $p_{BL}$.

These parameters are important to take into consideration for optimizing, planning and for determining amount of personnel support which is required for given wells 80A, 80B associated with corresponding boreholes 20A, 20B. It will be appreciated that certain wells 80 optionally only have a single associated borehole 20, whereas other wells 80 optionally have two or more boreholes 20, for example in a situation of expensive offshore platforms where directional drilling is employed. The inventors have found that episodic testing can adversely influence production from the system 10. Moreover, such episodic testing is also often insufficiently representative of continuous parameter temporal changes and/or sudden parameter temporal changes. When operating the system 10, for example implemented as a complex configuration of wells 80 and associated boreholes 20 serving the geological formation 30, it is desirable to maintain constant rates of productivity, injectivity and reservoir pressure $p_G$.

Figure 7:
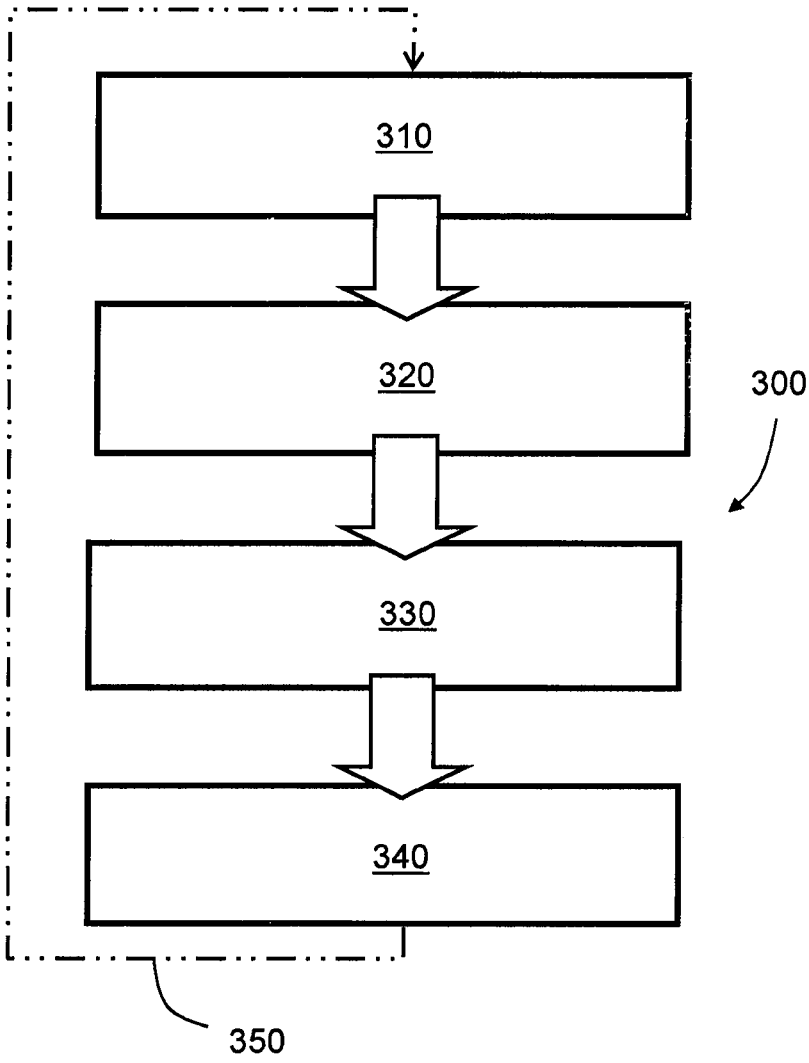
FIG. 7 is an illustration of functions included within a method of monitoring and controlling the system of FIG. 1.

The present invention employs, in overview, a form of algorithm 300 as depicted in FIG. 7. The algorithm 300 includes:

(a) a first function 310 concerned with historical values of measured parameters, for example flow rate "Q" (which is representative of the flow rate r), pressure P (representative of one or more of the pressures $p_{AU}$, $p_{AL}$, $p_{BU}$, $p_{BL}$);

(b) a second function 320 concerned with a conversion of measured parameters from the first function 310 to corresponding working abstract parameters for use in the algorithm 300;

(c) a third function 330 concerned with employing a Kalman filter for estimating fast and slow processes occurring within the facility 10 by processing converted parameters from the second function 320; and (d) a fourth function 340 concerned with response modelling and prediction based upon identified fast and slow processes from the third function 330.

The functions 310, 320, 330, 340 are optionally executed concurrently and feed data between them on a continuous basis. Alternatively, the functions 310, 320, 330, 340 are executed in sequence which is repeated by way of a return 350 from the fourth function 340 back to the first function 310. The algorithm 300 will now be elucidated in further detail.

A Kalman filter is a mathematical method which uses measurements that are observed in respect of time t that contain random variations, namely "noise", and other inaccuracies, and produces values that tend to be closer to true values of the measurements and their associated computed values. The Kalman filter produces estimates of true values of measurements and their associated computed values by predicting a value, estimating an uncertainty of the predicted value, and then computing a weighted average of the predicted value and the measured value. Most weight in the Kalman filter is given to the computed value of least uncertainty. Estimates produced by Kalman filters tend to be closer to true values than the original measurements because the weighted average has a better estimated uncertainty than either of the values that went into computing the weighted average.

Figure 8:
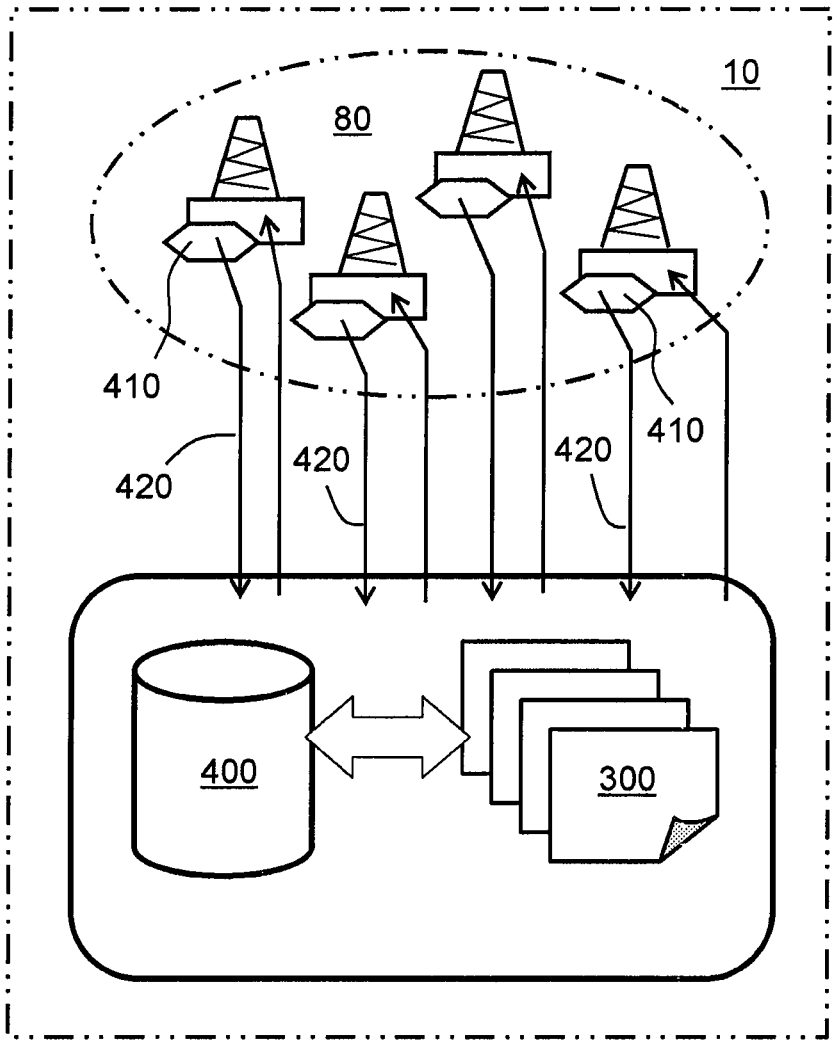
FIG. 8 is an illustration of the system of FIG. 1 coupled to computing hardware operable to execute software products for implementing a method pursuant to the present invention.

Referring to FIG. 8, the algorithm 300 is based on a Kalman filter formulation of an oil and/or gas production system 10 having $N_i$ injectors and $N_p$ producers. Downhole distal pressure measurements $p_{LA}$, $p_{LB}$ as well as wellhead proximate pressure measurements $p_{UA}$, $p_{UB}$ in the injector and producer boreholes 20A, 20B are made available to the algorithm 300. In certain situations, only wellhead proximate pressures $p_{UA}$, $p_{UB}$ are measured and corresponding data is supplied to the algorithm 300. The algorithm 300 is also provided with measurements of injection and production flow rates $r_A$, $r_B$ as a function of time t.

The Kalman filter formulation for $N_i$ injectors and $N_p$ producers is expressed by Equation 1 (Eq. 1):

$$\frac{dY_j(t)}{dt} = \sum_i K_{ji} \cdot Y_i(t) + \sum_p K_{jp} \cdot Y_p(t) + P^*_j(t) \quad \text{Eq. 1}$$

wherein

K=parameters of the system 10;

Y=output variable, measured response of the system 10;

P*=input variables to the system 10, namely pressure gradient to the system 10;

t=time; and i,j=reference indices, and wherein the output variable Y is defined by Equation 2 (Eq. 2) and Equation 3 (Eq. 3):

$$Y_j = \int_0^t [P_{w,j}(t') - P_r(0)]dt' \quad \text{Eq. 2}$$

$$P'_j(t) = \frac{Q_j(t)}{J_j} \quad \text{Eq. 3}$$

wherein Equation 4 (Eq. 4) defines a time derivative of the output variable:

$$\frac{dY_j}{dt} = P_{w,j}(t) - P_v(0) \quad \text{Eq. 4}$$

wherein $J_j$=set of parameters associated with the system 10.

The set of parameters $J_j$ in Equations 3 and 4 corresponds closely to an injectivity index and a productivity index. These indices are defined by physical properties of the fluids conveyed via the boreholes 20A, 20B and also porosity characteristics of the geological formation 30. Moreover, the set of parameters $K_{ji}$ and $K_{jp}$ represent an interaction between a well 80 "j" and an injector well 80A "i" or a producing well 80B "p", namely as depicted in FIG. 5.

In the aforementioned formulation, the time derivative of the output variable Y is affected by combination of pressure gradient, P*, related to the well 80 "j", and an influence from all system 10 variables at the time "t", including an influence from the well 80 "j" itself. In practice, the pressure gradient P* is susceptible to cause rapid changes as well as slow changes in operation of the system 10, whereas interactions between wells 80 are found normally to cause slow changes. Separating influences of fast processes within the system 10 from slow processes therein is significant for reducing a computational load when using the algorithm 300 to monitor and control the system 10.

In respect of slow changes occurring within the system 10, these are referred to as being "semi steady state" or "quasi steady state". A semi steady state for the system 10 and its associated geological formation 30 is defined as an operating condition wherein a rate of change of pressure within the geological formation 30 is independent of spatial location within the formation 30. Typically, the geological formation 30 achieves a semi steady state once initial pressure gradients have propagated within the geological formation 30 to reach its peripheral boundaries. It is feasible for the semi steady state to be a dynamic description, but its associated time scales need to be longer than a time frame in which transient events occur within the geological formation 30, for example at least a factor of 3 times difference in respective time frames.

Referring to Equation 1 (Eq. 1) above:

(a) an interaction part thereof represents changes in respect of time t regarding an effective pressure within the geological formation 30, namely "reservoir pressure", as it is manifest at a well 80 with index "j"; and (b) a pressure term thereof represents a change due to fluid flows into or out from the well 80 with index "j".

Disregarding effects related to water aquifer and out-of-zone injections, for example resulting from natural phenomena, a normal semi steady state formulation corresponds to a single well 80 formulation wherein effects of other wells 80 in the system 10 is only accounted for through changes in a common reservoir pressure so that Equations 5 and 6 (Eq. 5 and Eq. 6) can be then used to describe the system 10:

$$P_{w,j}(t) = P_r(0) + \frac{Q_i(t)}{J_j} + \frac{\Delta V(t)}{S} \quad \text{Eq. 5}$$

wherein $$\Delta V(t) = \sum_i \int_0^t Q_i(t')dt' + \sum_p \int_0^t Q_p(t')dt' \quad \text{Eq. 6}$$

wherein $S=c_i \cdot V_f$ for major activity and $Q_p \leq 0 = -|Q_p|$

The Kalman filter formulation of Equation 1 (Eq. 1) above enables a recursive solution to be achieved wherein a zero-order solution for describing the system 10 corresponds to a solution obtained without interaction. This conclusion derived from mathematic analysis has enabled the inventors to appreciate that the complex system 10 can be conveniently separated out into quasi steady state characteristics on the first hand, and short term dynamic characteristics on the other hand. Such a conclusion would not be obvious from superficial inspection of the system 10 wherein events within the system 10 would be expected to occur in a continuous temporal spectrum requiring very considerable computing power to model accurately.

Thus, a zero-order representation of the system 10 is provided in Equation 7 (Eq. 7) and Equation 8 (Eq. 8):

$$\frac{dY_j^{(0)}}{dt} = P_j^* = \frac{Q_j}{J_j} \quad \text{Eq. 7}$$

$$Y_j^{(0)} = \frac{\Delta V_j}{J_j} \quad \text{Eq. 8}$$

Such a zero-order representation in respect of Y is, in many ways, similar to a Hall plot employed in injection monitoring.

A first order representation of the system 10 is provided in Equation 9 (Eq. 9) and Equation 10 (Eq. 10):

$$\frac{dY_{w,j}^{(1)}}{dt} = \sum_i K_{ji} \cdot Y_j^{(0)} + \sum_p K_{jp} \cdot Y_p^{(0)} \quad \text{Eq. 9}$$

-continued $$= \sum_i K_{ji} \cdot \frac{\Delta V_i}{J_i} - \sum_p K_{jp} \cdot \frac{|\Delta V_p|}{J_p}$$

wherein interaction parameters are conveniently defined:

$$K_{ji} = \frac{J_i}{S},\ K_{jp} = \frac{J_p}{S} \quad \text{Eq. 10}$$

Equation 9 (Eq. 9) corresponds to the semi steady state formation as provided in Equation 5 (Eq. 5). Thus, the present invention provides a Kalman filter formulation which reproduces semi steady state conditions within the system 10. However, the Kalman filter formulation is also a generalization because it does not assume uniformity amongst wells 80, neither does it assume well 80 interaction through a common reservoir pressure. This is a major benefit provided by the present invention.

The present invention allows for an alternative formulation of Equation 1 (Eq. 1), by assigning pursuant to Equation 11 (Eq. 11):

$$\alpha_{ji} = K_{ji} - \frac{J_i}{S},\ \alpha_{jp} = K_{jp} - \frac{J_p}{S} \quad \text{Eq. 11}$$

which enables Equation 1 (Eq. 1) to be rewritten as Equation 12 (Eq. 12):

$$\frac{dY_j}{dt} = \sum_i \alpha_{ji} \cdot Y_i + \sum_p \alpha_{jp} \cdot Y_p + P_j^* + \Delta P_r, \quad \text{Eq. 12}$$

$$\text{wherein } \Delta P_r = \frac{\Delta V}{S}$$

The state variables $Y_j$ and Q are generated from a time series of borehole pressures $p_{LA}(t)$, $p_{LB}(t)$, an initial pressure within the geological formation 30, and measured and/or allocated flow rates $r_A$, $r_B$. The injectivities, productivities and a matrix describing interactivity between wells 80 are estimated.

Aforementioned methods of monitoring and controlling the system 10 are not only capable of predicted quasi steady state conditions within the system 10, but also coping with transient situations after closing or opening a well 80 of the system 10. The method of the invention is based upon an assumption that a transient occurring within the system 10 is so fast so that interaction portions of Equation 1 (Eq. 1) and Equation 12 (Eq. 12) remain constant during the period of the transient. The constant interaction portions is representative of an effective change in the pressure of the geological formation 30 as observed from a given well 80 with index j. In other words, the method of the invention assumes that a time period of transient events which occur within a given well 80 of the system 10 is much shorter than a time scale in which the geological formation 30 responds generally to the transient events.

For illustrating the present invention by example, injectivity during an injection transient occurring within the system 10 is described by Equation 13 (Eq. 13):

$$J_i(t) = \frac{4\pi hk}{\mu\left(\ln\left(\frac{\phi\mu c r_w^2}{}\right) + 0.7772\right)} = \frac{A}{\ln(t) + B} \quad \text{Eq. 13}$$

The method of the present invention, namely utilizing the algorithm 300, applied to monitor and control the system 10 would employ a data set corresponding to well 80 pressure/injection rate versus time. Whenever a shut-in or start-up of a given well 80 occurs within the system 10, sensor data from the given well 80 is provided to a computing arrangement at a sufficiently frequency for describing time scale of the shut-in and start-up.

The algorithm 300 is beneficially implemented as one or more software products stored on machine-readable data storage media. During operation of the system 10, the one or more software products are executable on computing hardware coupled via one or more interfaces to the multiple wells 80 whose boreholes 20 intersect with the geological formation 30. The one or more software products enable operation of the system 10 to be monitored, as well as accommodating control back to the multiple wells 80 of the system 10 for improving operation of the system 10. Such control can be optimized in several different ways, for example for maximum oil & gas production, for minimum maintenance and testing, for lowest operating pressure when there is a risk of fracture of the geological formation 30 for example.

As aforementioned, the algorithm 300 employs Kalman filter methods, or equivalent alternative estimation methods, to estimate model parameters for Equation 1 and Equation 12 (Eq. 1 and Eq. 12) based upon measurements of pressures p and rate r as a function of time t. The algorithm 300 employs two different time scales:

(a) a "fast loop" solution for determining estimations of individual parameters of individual wells 80. Time periods for the "fast loop" solution are minutes, potentially faster when transients in well 80 operation are to be monitored;

(b) the "slow" loop uses Equation 9 (Eq. 9), alternatively Equation 12 (Eq. 12), to estimate slow changes in either individual well 80 parameters or due to well 80 interaction effects.

In respect of the "fast-loop" solution, the algorithm 300 takes account of rapid changes in the system 10 such as opening and closing of wells 80, fracture events, and bursts or similar. These rapid changes are conveniently monitored by rapid measurable changes in injectivities and/or productivities. For example, a fracture resulting in a change of injectivity will be manifest as a rapid change in the injectivity of a particular well 80. The "fast-loop" solution employed in the algorithm 300 takes account of operational changes such as opening or closing chokes, opening or closing a sleeve and other changes modifying the response of the system 10 and/or its associated surface sub-system 400. On account of operational changes being known within the system 10, for example opening or closing of valves and chokes, discriminating between effects of operational changes and events determined by the boreholes 20 and the geological formation 30 is achieved within the algorithm 300. If aforementioned operation changes involve opening a sleeve to another layer, corresponding changes in productivity and/or injectivity provide useful information regarding chosen operating strategies.

The "fast-loop" and "slow-loop" solutions employed in the algorithm 300 take account of phenomena resulting in slow changes, for example over time periods of weeks, in parameters describing the system 10. Thus, the solutions take account of single well 80 as well as multi-well 80 changes within the system 10. Example multi-well 80 changes are accounted for in the interaction part of Equation 1 and Equation 12 (Eq. 1 and Eq. 12), for example changes in effective overall pressure in the geological formation 30 (i.e. "reservoir pressure"), "out-of-zone" injections and aquifer support. Example single well 80 changes include slow degradation or improvements in productivity and injectivity caused by skin developments or similar processes; "skin development" refers to formation of surface layers within the borehole 20 and in the geological formation 30 which resist flow of fluid via surfaces onto which the layers have formed, wherein the skin development can potentially have detrimental or beneficial characteristics depending upon circumstances. Moreover, the "fast loop" and "slow loop" solutions are also able to identify to long term effects of rapid event-type changes, for example as identified in changes in production and/or injection rates in wells 80.

The algorithm 300 is thus operable, via its Kalman filter, to compute estimates of parameters including:

(i) productivities and injectivities of the wells 80 of the gas and/or oil production system 10;

(ii) storage characteristics and/or change in average reservoir pressure of the geological formation 30;

(iii) interactivities between wells 80 of the system 10; and (iv) aquifer influx and/or "out-of-zone" outflux in respect of the geological formation 30 and its associated wells 80.

The algorithm 300, namely implemented in computing hardware 400 and sensing instruments 410 coupled thereto, has technical effect in that it senses physical conditions of the system 10 as sensed signals, analyses the signals, and then generates outputs which can be used for controlling operation of the system 10 to improve its productivity, increase operating safety and/or reduce maintenance costs. Improved operating safety is achieved by more appropriate control which assists to avoid blowouts, fractures and similar. Enhanced productivity is achieved by employing a more suitable injectivity strategy. Reduced maintenance can be achieved by maintaining appropriate productivity rates and/or injectivity rates for avoiding sedimentation which can block wells 80 and which is costly and time-consuming to rectify.

Although use of the algorithm 300 is described in relation to oil and/or gas production, it can also be used for controlling other types of industrial processes and also mining operations, for example continuous seabed suction systems for extracting valuable minerals from ocean floor sediments and silt; such ocean mining processes must maintain appropriate flow rates and move extraction nozzles to most valuable mineral deposits in a dynamic real-time basis, namely activities which are advantageously controlled by using computing hardware executing the algorithm 300.

The present invention is susceptible to being used with existing contemporary injection and production wells 80, both in on-shore applications and also in off-shore applications.

Modifications to embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

The invention claimed is:

1. A production monitoring system comprising a plurality of injection and production units coupled in operation to sensors for measuring physical processes occurring in the plurality of the injection and production units and generating corresponding measurement signals for computing hardware, wherein:

said computing hardware is operable to execute software products for processing said measurement signals, the software products are adapted for said computing hardware to analyze said measurement signals to abstract a parameter representation of said measurement signals, and to apply a temporal analysis of said parameter representation to identify temporally slow processes and temporally fast processes therein, and to employ information representative of said slow processes and fast processes to control a management process for controlling operation of the production monitoring system.

2. The production monitoring system as claimed in claim 1, wherein:

said injection and production units have associated therewith production and injection rates ($r_A$, $r_B$), together with upper and lower borehole pressures ($p_U$, $p_L$) as the measurement signals, and the management process is adapted to control said injection and production units in respect of one or more of: production rate, operating safety, and maintenance requirement.

3. The production monitoring system as claimed in claim 1, wherein said temporal analysis involves applying a temporal filter for analyzing temporal characteristics of said measurement signals by modelling said measurement signals, and determining deviations between said measurement signals and corresponding modelled measurement signals for identifying said temporally fast processes.

4. The production monitoring system as claimed in claim 3, wherein said temporal filter employs a Kalman filter.

5. The production monitoring system as claimed in claim 4, wherein the Kalman filter is formulated for $N_i$ injectors and $N_p$ producers as expressed by Equation 1 (Eq. 1):

$$\frac{dY_j(t)}{dt} = \sum_i K_{ji} \cdot Y_i(t) + \sum_p K_{jp} \cdot Y_p(t) + P_j^*(t) \quad \text{Eq. 1}$$

wherein

K=parameters of the production monitoring system;

Y=an output variable, measured response of the production monitoring system;

P*=input variables to the production monitoring system, namely pressure gradient to the production monitoring system;

t=time; and i,j=reference indices, and wherein the output variable Y is defined by Equation 2 (Eq. 2) and Equation 3 (Eq. 3):

$$Y_j = \int_0^t [P_{w,j}(t') - P_r(0)]dt' \quad \text{Eq. 2}$$

$$P_j'(t) = \frac{Q_j(t)}{J_i} \quad \text{Eq. 3}$$

wherein Equation 4 (Eq. 4) defines a time derivative of the output variable:

$$\frac{dY_j}{dt} = P_{w,j}(t) - P_v(0) \quad \text{Eq. 4}$$

wherein $J_j$=set of parameters associated with the production monitoring system; and $Q_j$=flow rate.

6. The production monitoring system as claimed in any one of claims 1 to 5, wherein said analysis is adapted for determining interaction between the injection and production units when intercepting a formation which is mutually common to the injection and production units.

7. The production monitoring system as claimed in any one of claims 1 to 5, wherein the injection and production units include at least one of: oil and/or gas wells, multiple apparatus in a production facility, continuous mining facilities, and geological water extraction facilities.

8. A method of monitoring a plurality of injection and production units, the method comprising steps of:

(a) using sensors coupled to the injection and production units for measuring physical processes occurring in the injection and production units and generating corresponding measurement signals for computing hardware, wherein said computing hardware is operable to execute software products for processing said measurement signals;

(b) using said computing hardware executing said software products to analyze said measurement signals to abstract a parameter representation of said measurement signals;

(c) using said computing hardware to apply a temporal analysis of said parameter representation to identify temporally slow processes and temporally fast processes therein; and (d) employing information representative of said slow processes and fast processes to control a management process for controlling operation of a production monitoring system.

9. The method as claimed in claim 8, wherein said injection and production units have associated therewith injection and production rates ($r_A$, $r_B$), together with upper and lower borehole pressures ($p_U$, $p_L$) as the measurement signals, and the management processes is operable to control said production units in respect of one or more of: production rate, operating safety, and maintenance requirement.

10. The method as claimed in claim 8, wherein said temporal analysis involves applying a temporal filter for analyzing temporal characteristics of said measurement signals by modelling said measurement signals, and determining deviations between said measurement signals and corresponding modelled measurement signals for identifying said temporally fast processes.

11. The method as claimed in claim 10, wherein said temporal filter employs a Kalman filter.

12. A software product recorded on a non-transitory machine-readable data storage medium, wherein said software product is executable on computing hardware for implementing a method as claimed in any one of claims 8 to 11.

* * * * *